United States Patent [19]

Maresch et al.

[11] Patent Number: 5,022,971

[45] Date of Patent: Jun. 11, 1991

[54] PROCESS FOR THE ELECTROLYTIC PICKLING OF HIGH-GRADE STEEL STRIP

[75] Inventors: Gerald Maresch, Mödling; Ulrich Krupicka, Vienna, both of Austria

[73] Assignee: Maschinefabrik Andritz Actiengesellschaft, Graz-Andritz, Austria

[21] Appl. No.: 406,342

[22] Filed: Sep. 13, 1989

[30] Foreign Application Priority Data

Sep. 14, 1988 [AT] Austria ..... 2258/88

[51] Int. Cl.[5] ..... C25B 1/06

[52] U.S. Cl. ..... 204/145 R

[58] Field of Search ..... 204/145 R

[56] References Cited

U.S. PATENT DOCUMENTS 4,851,092 7/1989 Maresch ..... 204/145 R

FOREIGN PATENT DOCUMENTS 240674 6/1965 Austria .
252685 3/1967 Austria .
2431554 3/1980 France .

*Primary Examiner*—T. M. Tufariello
*Attorney, Agent, or Firm*—Fleit, Jacobson, Cohn, Price, Holman & Stern

[57] ABSTRACT

In a process for the electrolytic pickling of a high-grade steel strip, in particular a hot strip of high-grade steel, the hot strip of high-grade steel is alternately anodically and cathodically pickled in an aqueous solution of $Na_2SO_4$ and subsequently in an aqueous solution of $NaNO_3$ and NaF, as a result of which the formation of dangerous nitrous gases is prevented.

13 Claims, No Drawings

PROCESS FOR THE ELECTROLYTIC PICKLING OF HIGH-GRADE STEEL STRIP

The invention relates to a process for the electrolytic pickling of high-grade steel strip, in particular hot strip of high-grade steel, in which the hot strip of high-grade steel is first alternately anodically and cathodically pickled in an aqueous neutral solution of $Na_2SO_4$.

Processes for the electrolytic pickling of high-grade steel in various acids, such as sulphuric acid or nitric acid for example, have been known for many years and have already become established worldwide. Processes of this type, however, require as a following stage a treatment in a mixed acid, such as for example a mixture of nitric acid and hydrofluoric acid, in order to remove the chromium-depleted layer on the surface. A problem recognized for some time in the case of these processes is that dangerous gases, such as nitrous gases, are released in this acid after-treatment.

As a result, various processes have been developed to avoid these nitrous gases by the addition of urea or hydrogen peroxide to the mixed acid.

In addition, an attempt has been made to treat the high-grade steel beforehand in an aqueous neutral salt solution and then to subject it to final pickling with mixed acid. Thus for example the Austrian Pat. Nos. 252 685 and 240 674 describe two-stage electrolytic pickling processes, the first pickling bath being an aqueous solution of a neutral alkali salt of a mineral acid, preferably sodium sulphate. An electrolytic pickling then takes place in aqueous solutions of mineral acids, for which purpose sulphuric, nitric, hydrochloric or mixed acids are indicated as examples. In all these named processes, however, it has been impossible or possible only to an unsatisfactory extent to prevent effectively the formation of toxic vapours, inter alia nitrous gases.

The object of the present invention is now to provide a process for the electrolytic pickling of high-grade steel strips, in which the formation of nitrous gases is completely prevented in the subsequent treatment and which additionally operates with a low outlay in cost and effort and provides a bright strip of high-grade steel which is free of scale.

This object is attained according to the invention in the case of a process of the type descsribed above in that the hot strip of high-grade steel is subsequently alternately anodically and cathodically pickled in an aqueous neutral salt solution which contains the same anions as the conventional $HNO_3$/HF mixed acid, the aqueous neutral salt solution being according to a further feature a solution of $NaNO_3$ and NaF.

A further feature of the process according to the invention is that the concentration of $NaNO_3$ amounts to between 100 and 400 g/l, preferably 200 to 300 g/l, and the concentration of NaF amounts to between 10 and 100 g/l, preferably between 40 and 60 g/l.

In accordance with a further feature of the process according to the invention the temperature in the solution of $NaNO_3$ and NaF amounts to between 20° and 90° C., preferably between 60° and 80° C.

It is provided as a further feature of the process according to the invention that the anodic and the cathodic current density during the electrolytic pickling in the solution of $NaNO_3$ and NaF amounts to between 1 and 50 A/dm$^2$, preferably between 10 and 30 A/dm$^2$.

After the scaled high-grade steel strip has been alternately anodically and cathodically pickled in an aqueous solution of $Na_2SO_4$, it is rinsed and brushed with plastics brushes. After this, in order to remove the remaining adhering scale, it is alternately anodically and cathodically pickled in an aqueous neutral salt solution which contains the same anions as the conventional mixture of nitric acid and hydrofluoric acid. A solution of $NaNO_3$ and NaF is preferably used for this purpose. After the subsequent final rinse, which likewise comprises a mechanical cleaning of the strip with brushes, a bright strip of high-grade steel which is free of scale is obtained.

The neutral salt solution is generally produced by the addition of the respective nitrates or fluorides in the desired quantity in water. Other methods of preparation are possible, however, in particular in the line of experimental plants of smaller dimensions, where for example neutralization of $HNO_3$/HF mixed acids with lyes can take place. Economic considerations lead to the use of sodium salts, since these are most advantageous in terms of cost, but the use of nitrates and fluorides with other cations, such as potassium for example, is equally possible.

The formation of nitrous gases is prevented by the electrolytic pickling with $NaNO_3$ and NaF, since the high-grade steel strip is not pickled in acid, but the acid is produced by electrolysis only where it is required.

A further advantage of this process according to the invention is that the dissolved scale does not go into solution as a salt and so use up acid, but is immediately precipitated as hydroxide.

This metal hydroxide slurry produced during the pickling is removed from the solution by mechanical methods, such as for example filters, concentrators or centrifuges. In this way not only is the consumption of chemicals reduced, but also easily deposited metal hydroxides are produced.

Further details and advantages of the present process according to the invention are described below with reference to examples of embodiment:

EXAMPLE 1

A hot strip of high-grade steel of the quality AISI 304 was irradiated in a combined annealing and pickling line before the pickling, in order partly to remove the scale on the surface, and it was then electrolytically pickled alternately anodically and cathodically in an aqueous $Na_2SO_4$ solution, a concentration of 150 g/l with 10 A/dm$^2$, the temperature being maintained in the range of between 60° and 80° C. For comparison with the process according to the invention the high-grade steel strip was first subjected to the final pickling in a purely chemical manner in the same temperature range in an aqueous solution of 150 g/l of $HNO_3$ per liter and 25 g of HF per liter in order to remove the chromium-depleted layer. The strip was free of scale, but nitrous gases in a concentration of 500 to 800 ppm, which had to be removed from the waste gas in the waste-gas cleaning plant, were formed in the acid during the pickling.

EXAMPLE 2

In the same plant and with unchanged parameters an aqueous 10–20% solution of urea was added to the second pickling bath in order to reduce the emission of nitrous gases, as a result of which the concentration of nitrous gases was reduced from 500 to 800 ppm to 100 to 150 ppm, but could not be completely eliminated.

EXAMPLE 3

In order to be able to treat the strip in accordance with the process according to the invention, the acid was subsequently neutralized with caustic soda, so that an aqueous neutral solution with a concentration of 200 g/l $NaNO_3$ and 50 g/l NaF was obtained. The pickling tub was provided with electrodes, and the latter were connected to a rectifier. With a current density of 20 $A/dm^2$ and in the same temperature range as in Example 1 a scale-free strip was likewise obtained at the same treatment speed in the plant, but there were no emissions of nitrous gases in the suction plant.

EXAMPLE 4

The tests were repeated with identical parameters as in the case of the first three examples with a hot ferrite strip of the quality AISI 430. During the pickling with acid, 3000 to 5000 ppm of nitrous gases were produced, which could be reduced to 500 to 750 ppm by the addition of urea. If on the other hand the after-treatment was carried out with an aqueous $NaNO_3$ and NaF solution, no nitrous gases were produced and the high-grade steel strip was likewise free of scale for the same length of treatment and speed of the plant.

EXAMPLE 5

Both high-grade steel strips were rolled in a cold rolling mill, and were then annealed and pickled once more. Here too no nitrous gases were produced during the subsequent treatment in the $NaNO_3$-NaF solution, whereas during the pickling in acid 300 to 500 ppm of nitrous gases in the case of AISI 304 and 800 to 1000 ppm in the case of AISI 430 were measured in the waste gas.

We claim:

1. A process for the electrolytic pickling of high-grade steel strip, comprising the steps of: first alternately anodically and cathodically pickling a strip of high-grade steel in an aqueous neutral solution of $Na_2SO_4$, the concentration of $Na_2SO_4$ in the aqueous solution amounting to between 50 and 300 g/l, at a temperature amounting to between 20° and 90° C., and the anodic and cathodic current density during the electrolytic pickling amounting to between 1 and 50 $A/dm^2$, and subsequently alternately anodically and cathodically pickling the strip of high-grade steel cathodically pickling the strip of high-grade steel in an aqueous neutral salt solution which contains the same anions as a conventional $HNO_3$/HF mixed acid.

2. A process according to claim 1, characterized in that the aqueous neutral salt solution is a solution of $NaNO_3$ and NaF.

3. A process according to claim 2, characterized in that the concentration of $NaNO_3$ amounts to between 100 and 400 g/l, and the concentration of NaF amounts to between 10 and 100 g/l.

4. A process according to claim 2, characterized in that the temperature in the $NaNO_3$/NaF solution amounts to between 20° and 90° C.

5. A process according to claim 2, characterized in that the anodic and the cathodic current density during the electrolytic pickling in the $NaNO_3$/NaF solution amounts to between 1 and 50 $A/dm^2$.

6. A process according to claim 1, characterized in that the strip of high-grade steel is a hot strip of high-grade steel.

7. A process according to claim 1, characterized in that the concentration of $Na_2SO_4$ in the aqueous solution amounts to between 100 to 200 g/l.

8. A process according to claim 1, characterized in that the temperature amounts to between 60° and 80° C.

9. A process according to claim 1, characterized in that the anodic and cathodic current density during the electrolytic pickling amounts to between 10 and 30 $A/dm^2$.

10. A process according to claim 2, characterized in that the concentration of $NaNO_3$ amounts to between 200 and 300 g/l.

11. A process according to claim 2, characterized in that the concentration of NaF amounts to between 40 and 60 g/l.

12. A process according to claim 2, characterized in that the temperature in the $NaNO_3$/NaF solution amounts to between 60° and 80° C.

13. A process according to claim 2, characterized in that the anodic and the cathodic current density during the electrolytic pickling in the $NaNO_3$/NaF solution amounts to between 10 and 30 $A/dm^2$.

* * * * *